US008690584B2

(12) United States Patent
Shiga

(10) Patent No.: US 8,690,584 B2
(45) Date of Patent: Apr. 8, 2014

(54) CONTACT PROBE DEVICE HAVING A SUBSTRATE FITTED INTO SLITS OF CYLINDRICAL ELECTRODES

(75) Inventor: Mototsugu Shiga, Kanagawa (JP)

(73) Assignee: Elmec Corporation, Kawasaki-shi (JP)

( * ) Notice: Subject to any disclaimer, the term of this patent is extended or adjusted under 35 U.S.C. 154(b) by 881 days.

(21) Appl. No.: 12/921,650

(22) PCT Filed: May 30, 2008

(86) PCT No.: PCT/JP2008/060018
§ 371 (c)(1),
(2), (4) Date: Sep. 9, 2010

(87) PCT Pub. No.: WO2009/144812
PCT Pub. Date: Dec. 3, 2009

(65) Prior Publication Data
US 2011/0006795 A1 Jan. 13, 2011

(51) Int. Cl.
*H01R 12/00* (2006.01)

(52) U.S. Cl.
USPC ..... 439/66

(58) Field of Classification Search
USPC ..... 439/65–67, 74, 591
See application file for complete search history.

(56) References Cited

U.S. PATENT DOCUMENTS 3,954,317 A * 5/1976 Gilissen et al. ..... 439/591
4,076,356 A * 2/1978 Tamburro ..... 439/426
5,796,588 A * 8/1998 Machida et al. ..... 361/773
5,938,451 A * 8/1999 Rathburn ..... 439/66
6,217,342 B1 4/2001 Neidich et al.
7,134,880 B2 * 11/2006 Arai et al. ..... 439/66
2005/0266703 A1 12/2005 Noda et al.
2006/0009055 A1 1/2006 Li

FOREIGN PATENT DOCUMENTS

JP 4-133365 U 12/1992
JP 2000-311733 A 11/2000
JP 2002-022769 A 1/2002
JP 2003-282168 A 10/2003

OTHER PUBLICATIONS

International Search Report of PCT/JP2008/060018, mailing date Jul. 1, 2008.
Notification of Concerning Transmittal of International Preliminary Report on Patentability (Forms PCT/IB/326) of International Application No. PCT/JP2008/060018 mailed Dec. 9, 2010 with Forms PCT/IB/373 and PCT/ISA/237.

* cited by examiner

*Primary Examiner* — Chandrika Prasad
(74) *Attorney, Agent, or Firm* — Westerman, Hattori, Daniels & Adrian, LLP

(57) ABSTRACT

To obtain a satisfactory contact state in an ultra high frequency range with a low loss, in a contact probe device with an electronic component connected to a mounting substrate. Insulating substrate 1 has cuts 3 with narrow width formed from an outer peripheral end. Cylindrical electrodes 9 are made of a conductive material and have slits 9*a* extending in its axial direction. A plurality of cylindrical electrodes 9 are supported by the insulating substrate 1 in such a manner as being inserted into each cuts 3 so that the insulating substrate 1 is fitted into each slit 9*a*.

6 Claims, 9 Drawing Sheets

A

B

A

B

CONTACT PROBE DEVICE HAVING A SUBSTRATE FITTED INTO SLITS OF CYLINDRICAL ELECTRODES

TECHNICAL FIELD

The present invention relates to a contact probe device, and relates to an improvement of the contact probe device for connecting a component such as a chip-like electronic component to a mounting substrate in an electronic device.

DESCRIPTION OF RELATED ART

In recent years, an electronic component mounted on a mounting substrate, which can be used in an ultra high speed frequency range exceeding 10 GHz, has been requested, in accordance with an increase in a speed of an operation in an electronic circuit formed on the mounting substrate in an electronic device.

In order to prevent deterioration of the frequency characteristics due to inductance components of terminals formed in an electronic component, the electronic component that can be used in the ultra high speed frequency range has generally a leadless chip structure or a ball grid array (BGA) structure constituted of solder balls.

However, in the electronic component having the ball grid array (BGA) structure, in an experimental stage, when the electronic component is soldered to connect to the mounting substrate by manual work using a soldering iron, the solder balls are deformed at the moment when the iron is brought into contact with the solder balls, and there is a tendency that such solder balls can be hardly used as terminals. Then, the electronic component is hardly connected to the mounting substrate with hand solder, thus requiring thousands of man-hours for building a test model.

Therefore, the electronic component which can be used in the ultra high frequency range, has the chip structure more frequently.

However, in the electronic component with the chip structure, when there is a large number of terminals, there is a problem that when the electronic component needs to be desoldered in a case of re-adjustment or change of a constant after being soldered to the mounting substrate, the electronic component is hardly desoldered, thus damaging the mounting substrate in some cases.

Therefore, there is provided a contact probe which can realize easy attachment and detachment of a chip-like electronic component, which can be used for the connection between the electronic device and the land of mounting substrate, and which can be used in the high frequency range of 10 GHz or more.

As this kind of structure, for example the contact probe disclosed in Japanese Patent Laid Open Publication No. 2002-22769 (Patent document 1) is proposed.

The patent document 1 provides the contact probe, in which an outer periphery of a cylindrical body made of easily elastically deformable synthetic resin such as fluorine resin or silicon resin having a heat-resistant property, is coated with a thin metal film, and which is capable of effectively absorbing irregularities even if there are such irregularities in the electronic component to be inspected, and also capable of realizing miniaturization and low contact resistance between the electronic component and the mounting substrate.

PATENT DOCUMENT 1

Japanese Patent Laid Open Publication No. 2002-22769 (Disclosure of the Invention)

Problem to be Solved by the Invention

However, in the aforementioned patent document 1, a metal film is thinly formed on a cylindrical body made of easily elastically deformable synthetic resin, and therefore in a process of repeating contact with the electronic component, deformation of the metal film is also repeated, thus easily allowing cracks in this part and making it difficult to stably obtain a satisfactory contact with the electronic component with passage of time, thus involving a problem in a long time durability.

Further, the metal film is formed on the cylindrical body made of synthetic resin by electroless plating. However, there is a problem that the electroless plating applied to an insulating synthetic resin is a special technique, thereby bringing about a cost increase.

In order to solve the above-described problem, the present invention is provided, and an object of the present invention is to provide a contact probe device capable of easily and surely realizing a stable contact between a chip-like electronic component and a mounting substrate.

Further, another object of the present invention is to provide a contact probe device capable of obtaining satisfactory frequency characteristics, in an ultra high frequency range of 10 GHz or more.

Means for Solving the Problem

In order to solve the above-described problem, the present invention provides a contact probe device, comprising:

an insulating substrate having a plurality of cuts with narrow widths formed from an outer peripheral end; and a plurality of cylindrical electrodes made of a conductive plate material, formed in an appearance of cylindrical shapes, and having slits extending in the axial direction, in such a manner as being supported by the insulating substrate by being inserted into the cuts of the insulating substrate so that the insulating substrate is fitted into the slits.

Further, the present invention provides the contact probe device, wherein the insulating substrate has flexibility.

Further the present invention provides the contact probe device, comprising a frame-type insulating case into which the insulating substrate, with the cylindrical electrodes supported thereon, is fitted from one of the main surface sides, and in which a space is formed where the cylindrical electrodes and a main essential area of the insulating substrate are exposed on the opposed main surface side.

The present invention provides the contact probe device, comprising a metal guide plate that covers at least a lateral outer periphery of the insulating case, with a fixing piece protruded therefrom so as to be fixed to the mounting substrate of the electronic device.

The present invention provides the contact probe device, wherein a pressing member for pressing the electronic component stored in the space on the opposed main surface side, is supported by the metal guide plate.

The present invention provides the contact probe device, wherein the pressing member has a nut member supported by the metal guide plate, and a screw member screwed into the nut member.

Advantage of the Invention

According to the contact probe device of the present invention, the cylindrical electrodes are supported by the insulating substrate, by being inserted into the cuts of the insulating substrate, so that such individual cylindrical electrode can be independently elastically brought into contact with external electrodes. Therefore, stable contact can be easily and surely realized, between the chip-like electronic component and the cylindrical electrodes, and between the cylindrical electrodes and the external mounting substrate, and also satisfactory frequency characteristics can be obtained in an ultra high frequency range.

According to the contact probe device of the present invention, the insulating substrate has flexibility, and therefore, for example, even if the chip-like electronic component, etc, is slightly deformed, the chip-like electronic component can be brought into contact with the electrodes of the mounting substrate along such a deformation, thus making it possible to simply and surely realize a further stable contact.

According to the contact probe device of the present invention, the frame-type insulating case is provided, into which the insulating substrate is fitted from one of the main surface sides and in which a space is formed where the cylindrical electrodes and the main essential area of the insulating substrate are exposed on the opposed main surface side. With this structure, by storing the electronic component in this space, the electronic component can be placed so that the electronic component can be attached and detached to/from the cylindrical electrodes. Thus, positioning of the electronic component is facilitated.

According to the contact probe device of the present invention, the metal guide plate is provided, for covering at least the lateral outer periphery of the insulating case, with a fixing piece protruded therefrom so as to be fixed to the mounting substrate of the electronic device. With this structure, the device can be easily fixed to the mounting substrate.

According to the contact probe device of the present invention, the pressing member for pressing the electronic component stored in the space on the opposed main surface side, is supported by the metal guide plate. With this structure, the electronic component can be pressed to the cylindrical electrodes, and through such a press, further sure contact between the external electrodes and the cylindrical electrodes can be secured.

According to the contact probe device of the present invention, the pressing member has the nut member supported by the metal guide plate, and the screw member screwed into the nut member. With this structure, the electronic component can be detachably and attachably pressed to the cylindrical electrodes.

BEST MODE FOR CARRYING OUT THE INVENTION

Preferred embodiments of the present invention will be described hereafter, with reference to the drawings.

FIG. 1 and FIG. 2 are a perspective view and an exploded perspective view of a contact probe device A according to an embodiment of the present invention.

In FIG. 1 and FIG. 2, insulating substrate 1 has flexibility and is a thin substrate with a thickness of 0.2 mm, which is made of a publicly-known excellent insulating resin material having flexibility and satisfactory frequency loss characteristics, and which is formed into, for example, a rectangular shape with a long side of 6 mm and a short side of 4 mm, and a plurality of cuts 3 cut by 1.2 mm from the outer peripheral end, such as one on the opposed short sides 1*a* respectively, and four on the opposed long sides 1*b* respectively.

The cuts 3 are formed at formation pitches (intervals) of the electrodes 7 for external connection provided on the outer periphery of an electronic component 5 as will be described later, and cross-sectional C-shaped cylindrical electrodes 9 are respectively fitted into the cuts 3 respectively.

As spring electrodes having slits 9*a* extending in the axial direction, the cylindrical electrodes 9 are formed into cylindrical shapes (roll shapes) with a length of about 1 mm in an axial direction and outer diameter of 0.8 mm, by using conductive plate materials such as a thin stainless plate or a phosphor bronze plate, with a thickness of 0.1 mm.

Each cylindrical electrode 9 is inserted into each cut 3, so that the insulating substrate 1 is fitted into each slit 9*a*, and is arranged on an outer edge portion of the insulating substrate 1 in a circular pattern, so that an end portion forming the slit 9*a* is elastically brought into contact with front/rear surfaces of the insulating substrate 1.

Each cut 3 of the insulating substrate 1 is formed, with approximately the same length as an axial dimension of the cylindrical electrode 9, and with a width slightly larger than the thickness of the stainless plate of the cylindrical electrode 9, by using conventionally known machining means such as a dicing saw or a router machine.

FIG. 2 shows a state before the cylindrical electrodes 9 are inserted into the insulating substrate 1, so as to be easy to understand the cuts 3 of the insulating substrate 1.

As shown in FIG. 3, the contact probe device A of the present invention thus constituted, is used in such a manner that a chip-like electronic component 5 such as an electromagnetic delay line in which a plurality of electrodes 7 for external connection are formed on an outer periphery, is placed on the insulating substrate 1, and this insulating substrate 1 is brought into contact with a plurality of pattern electrodes 13 formed on the mounting substrate 11 of a publicly-known electronic device (not shown).

Note that a plurality of pattern electrodes 13 on the mounting substrate 11 are formed by a conventionally known technique, corresponding to positions where the cylindrical electrodes 9 of the contact probe device A are arranged. Further, the cylindrical electrodes 9 (cuts 3) of the contact probe device A are formed corresponding to positions where the electrodes 7 of the electronic component 5 are arranged.

When the electronic component 5 is a chip-like electromagnetic delay line with a built-in delay line circuit, in FIG. 3, for example electrodes 7*a* and 7*b* are an input electrode and an output electrode of the built-in delay line, and electrodes 7*c*, 7*d*, 7*e*, and 7*f* are ground electrodes of the built-in delay line (the same thing can be said for FIG. 4 as will be described later).

FIG. 4 shows an ideal structure in which the electronic component 5 is directly brought into contact with the mounting substrate 11, and electrodes 7 of the electronic component 5 are directly connected to the pattern electrodes 13.

FIGS. 5A and 5B show a comparison of frequency characteristics, between the high frequency probe device A of FIG. 3 according to the present invention, and a conventional structure of FIG. 4, from the viewpoint of reflection magnitude and transmission magnitude. In the electronic component 5, shortest connection is made between the input/output electrodes 7*a* and 7*b*, and characteristics impedance is also set to a desired value.

According to FIGS. 5A and 5B, slight deterioration is observed in the transmission magnitude in the characteristics (thick solid line) of the high frequency probe device A of the present invention, compared with the characteristics (thin solid line) of the ideal structure of FIG. 4. However, sufficiently favorable results are shown in the frequency range exceeding 10 GHz, in both the reflection magnitude (return loss: S11 of S parameter) and the transmission magnitude (insertion loss: S21 of S parameter).

In addition, although resistivity of the stainless plate of the cylindrical electrode 9 is slightly higher than the resistivity of copper, etc, the cylindrical electrode 9 has a small shape, and therefore loss can be ignored in the high frequency probe device A of the present invention, thus realizing a favorable use thereof.

Accordingly, the high frequency probe device A of the present invention comprises: a flexible insulating substrate 1 having a plurality of cuts 3 with narrow widths formed from the outer peripheral end; and the cylindrical electrodes 9 made of the conductive material and formed into the cylindrical shapes and having the slits extending in the axial direction, in such a manner as being supported by the insulating substrate 1 by being inserted into the cuts 3 so that the insulating substrate 1 is fitted into the slits 9*a*.

Therefore, each cylindrical electrode 9 itself has elasticity and is elastically protruded from the opposed surface of the insulating substrate 1. Accordingly, even in a state that a contact surface of either one or both the electronic component 5 and the mounting substrate 11 are warped to thereby lose flatness, all cylindrical electrodes 9 of the insulating substrate 1 are surely independently brought into contact with both the electrode 7 of the electronic component 5 and the pattern electrodes 13 of the mounting substrate 11.

In addition, the cylindrical electrodes 9 are brought into contact with the electrodes 7 of the electronic component 5 and the pattern electrodes 13 of the mounting substrate 11 in a line contact state. Therefore, from this point as well, a satisfactory contact state is easily secured.

Further, the contact is satisfactory between all cylindrical electrodes 9 including a part of the cylindrical electrodes 9 that function as ground electrodes, and the electrodes 7 of the electronic component 5 and the pattern electrodes 13 of the mounting substrate 11, and therefore sufficient practical use is possible even in the ultra high frequency range of 10 GHz or more. Therefore, in view of this point, if the contact state of the ground electrodes is not satisfactory, loss in the ultra high frequency range is easily increased and the cause of the loss is hardly understood.

Next, an application example of the contact probe device A of the present invention will be described.

FIG. 6 and FIG. 7 are a perspective view and an exploded perspective view showing a first application example of the contact probe device A according to the present invention.

As shown in FIG. 6, the first application example has an insulating case 15 for holding the insulating substrate 1, and a metal guide plate 17 for covering an outer periphery of the insulating case 15, in addition to the insulating substrate 1 with cylindrical electrodes 9 arranged thereon.

As shown in FIG. 7A, the insulating case 15 has a relatively flat frame-type shape, wherein the insulating substrate 1 having the cylindrical electrodes 9 is fitted from one of the main surface sides (lower surface side in FIG. 7), so that the cylindrical electrodes 9 inserted into the insulating substrate 1 are not detached from the insulating substrate 1 by the insulating case 15.

The insulating case 15 has a space 19 on the opposed main surface side (upper surface side in FIG. 7), wherein the cylindrical electrodes 9 and a main essential area surrounded by the cylindrical electrodes 9 on the insulating substrate 1 are exposed from the upper surface side in the figure. The space 19 functions as a storage part of the electronic component 5.

In addition, although not shown, the cylindrical electrodes 9 arranged on the insulating substrate 1 are partially protruded downward from one of the main surface sides (lower surface side in FIG. 7) of the insulating case 15, so that as shown in FIG. 6, the electrodes 7 of the electronic component 5 are brought into contact with the cylindrical electrodes 9, when the electronic component 5 is stored in the space 19.

As shown in FIG. 7B, the metal guide plate 17 is made of a conductive metal plate such as a copper plate and formed into a rectangular C-shaped frame member, and covers at least the lateral outer periphery of the insulating case 15 in contact therewith.

In the metal guide plate 17, a plurality of fixing pieces 17*a* in contact with the pattern electrodes 13 of the mounting substrate 11 are integrally protruded outward and downward into L-shape, from one of the main surface sides (lower surface side in FIG. 7). Meanwhile, pressing pieces 17*b*, being pressing members for pressing four corners of the insulating case 15, are integrally bent and protruded toward inside from other main surface side (upper surface side in FIG. 7).

The outer periphery of the insulating case 15 holding the insulating substrate 1, is covered with the metal guide plate 17. In this structure, as shown in FIG. 6, fixing pieces 17*a* are overlapped and soldered with/to the plurality of pattern electrodes 13 on the mounting substrate 11.

Note that the pattern electrodes 13 on the mounting substrate 11 with the fixing pieces 17*a* connected thereto, are ground electrodes or dummy lands.

In a state that the metal guide plate 17 is fixed to the pattern electrodes 13 on the mounting substrate 11, four corners of the insulating case 15 are pressed toward the mounting substrate 11 by the pressing pieces 17*b* of the metal guide plate 17, and the cylindrical electrodes 9 arranged on the insulating substrate 1 are brought into press-contact with the pattern electrodes 13 on the mounting substrate 11, and a reliable contact is thereby secured.

According to the structures of FIG. 1 to FIG. 7, the electronic component 5 itself is not held with pressure, so that an inspection of the electronic component 5 is facilitated. However, in the present invention, a mechanism of holding the electronic component 5 with pressure, may also be acceptable, and such a pressure-holding mechanism is applied optimally at a place where exchange of the electronic component 5 is expected, at the time of a trial manufacture of the electronic device.

FIG. 8 and FIG. 9 are a perspective view and an exploded perspective view showing a second application example and a third application example of the contact probe device A of the present invention, wherein the structure of the first application example is utilized.

As shown in FIG. 8A, the second application example has a pressing member 21 including a nut member 21*a* supported by the metal guide plate 17, and a screw member 21*b* screwed into the nut member 21*a*.

Namely, as shown in FIG. 8B, opposed portions of the metal guide plate 17 are formed in a rising state so as to be longer than a thickness of the insulating case 15, and tip ends are formed in a state of bending inside, to thereby form supporting parts 17*c* in the shape of a rail.

Supporting slot 21*c* formed in the nut member 21*a* is inserted into each supporting part 17*c* of the metal guide plate 17, and the metal guide plate 17 is supported by the supporting part 17*c* in such a manner that the nut member 21*a* and the insulating substrate 1 (electronic component 5) are disposed face to face.

The screw member 21*b* is screwed into the nut member 21*a* so as to enable back and forth movement, and by screwing the screw member 21*b*, the electronic component 5 mounted on the cylindrical electrodes 9 of the insulating substrate 1 can be pressed to the cylindrical electrodes 9.

As shown in FIG. 9A, in the same way as the second application example, the third application example has the pressing member 21 including the nut member 21*a* and the screw member 21*b* screwed into the nut member 21*a*. However, a supporting structure of the nut member 21*a* is different from that of the second application example.

Namely, as shown in FIG. 9B, the opposed portions of the metal guide plate 17 are formed in a rising state so as to be longer than the thickness of the insulating case 15, and the opposed portions are connected by a connecting piece 17*d* in such a manner as facing the insulating substrate 1.

Meanwhile, the space 19, being the storage part of the electronic component 5 formed in the insulating case 15, functions also as the storage part of the nut member 21*a*, and a rotation of the nut member 21*a* stored in the space 19 is suppressed by the storage part.

Then, the electronic component 5 mounted on the cylindrical electrodes 9 can be pressed to the cylindrical electrodes 9, by inserting the screw member 21*b* into the nut member 21*a* from a hole 17*e* formed in the connecting piece 17*d* of the metal guide plate 17, and making this screw member 21*b* carry out back and forth movement.

The second and third application examples have a mechanism of pressing and holding the electronic component 5 itself. Therefore, such a pressing and holding mechanism is applied optimally at a place where the exchange of the electronic component 5 is expected, at the time of a trial manufacture of the electronic device.

Note that in the present invention, shapes of the insulating case 15 and the metal guide plate 17 are not limited to those as described above, and the shape of the pressing member 21 is not limited to a combined shape of the nut member 21*a* and the screw member 21*b* as shown in FIG. 8 and FIG. 9.

DESCRIPTION OF SIGNS AND NUMERALS

Figure 1:
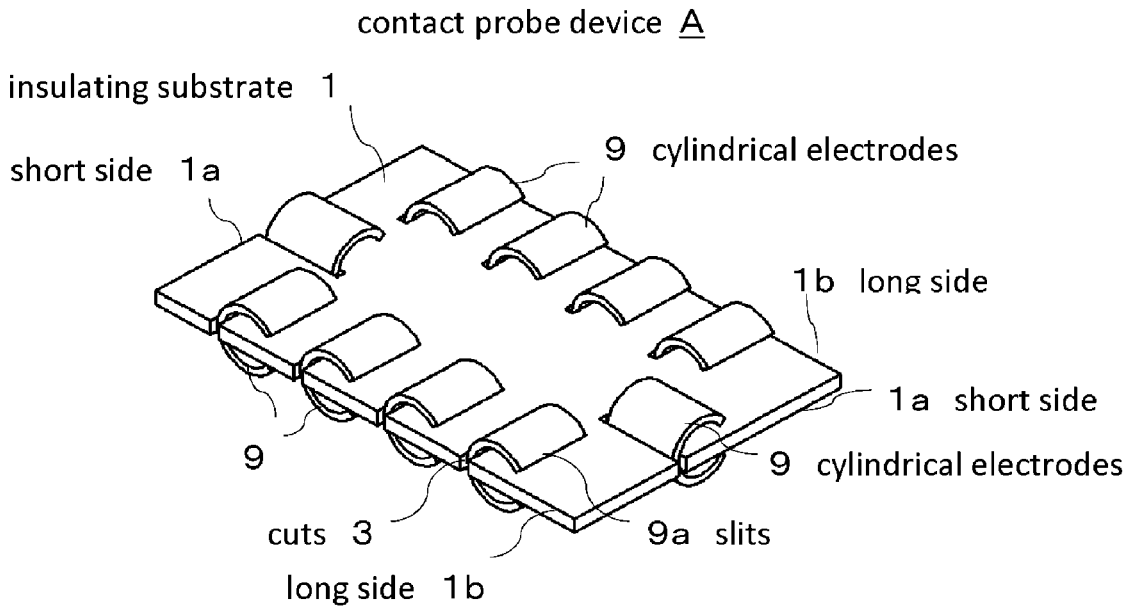
FIG. 1 is a perspective view of a contact probe device according to an embodiment of the present invention.
Figure 2:
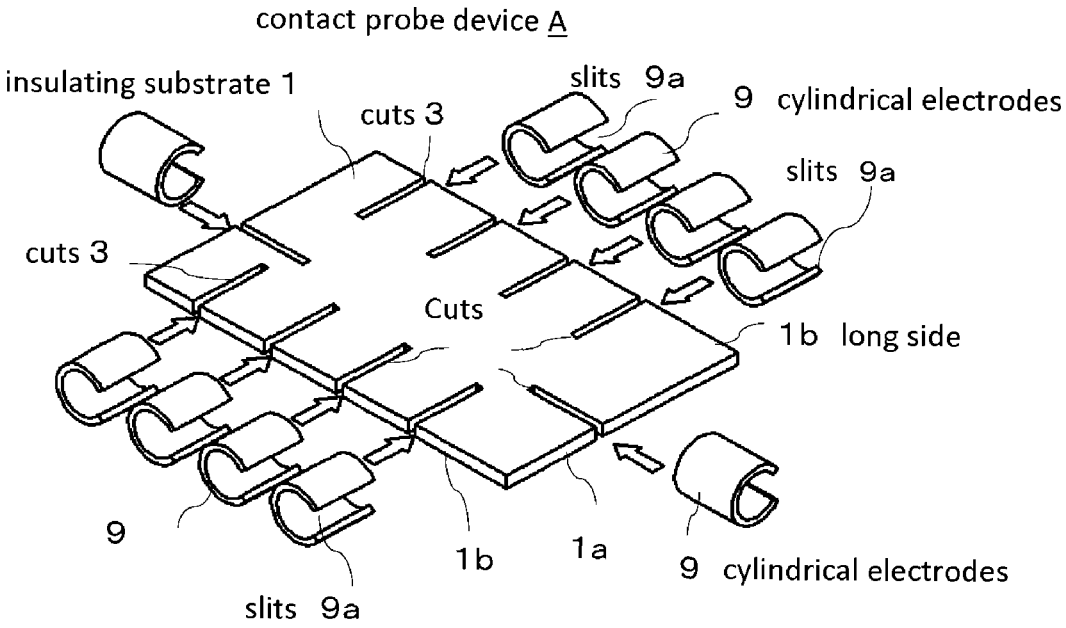
FIG. 2 is an exploded perspective view of the contact probe device of FIG. 1.
Figure 3:
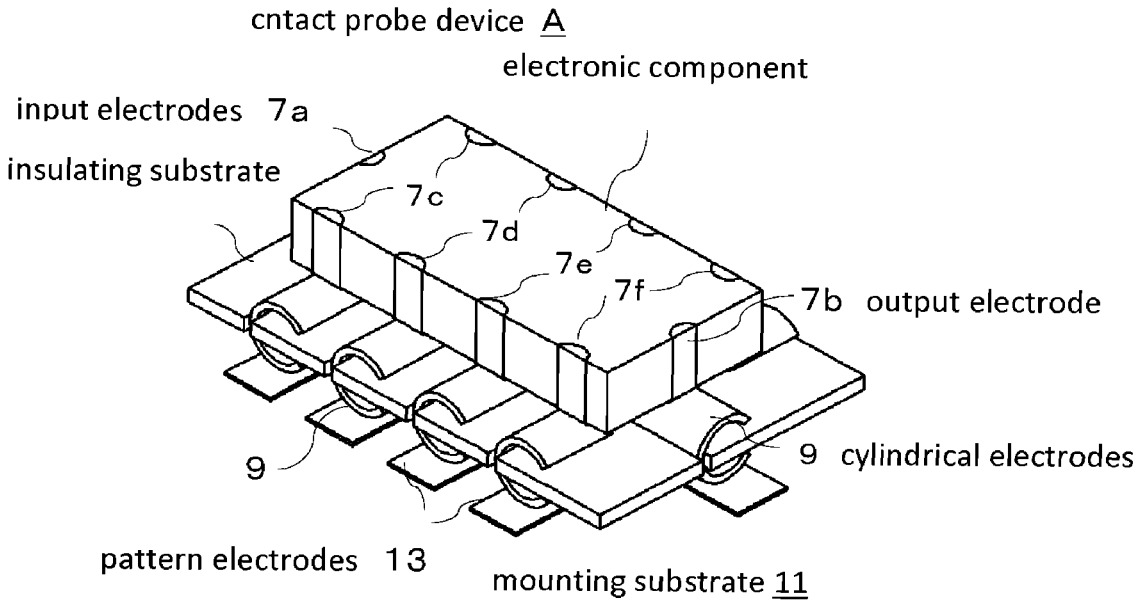
FIG. 3 is a perspective view explaining a use example of the contact probe device of the present invention.
Figure 4:
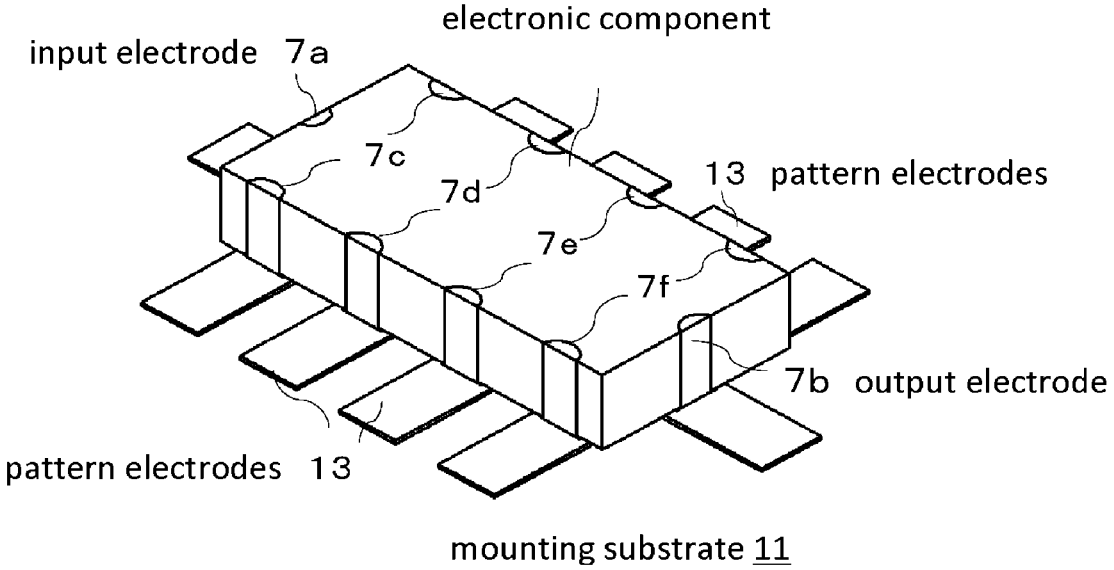
FIG. 4 is a perspective view explaining an ideal connection structure of an electronic component.
Figure 5:
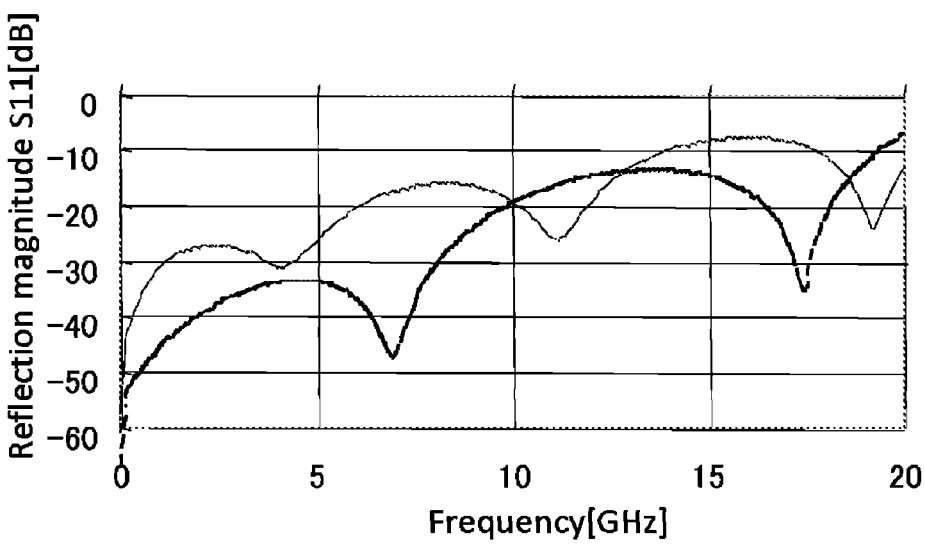
FIG. 5 is a characteristic view comparing the contact probe device of the present invention, with that of a conventional example.
Figure 5:
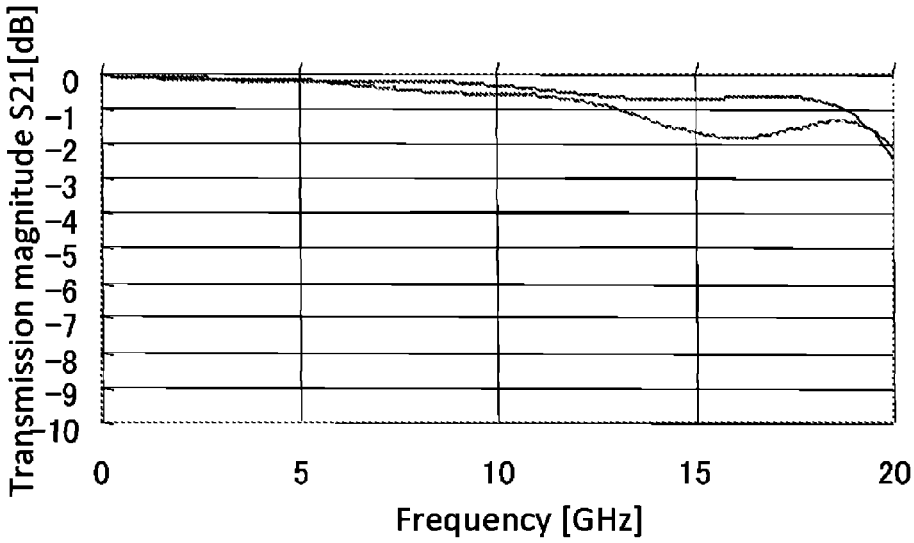
Figure 6:
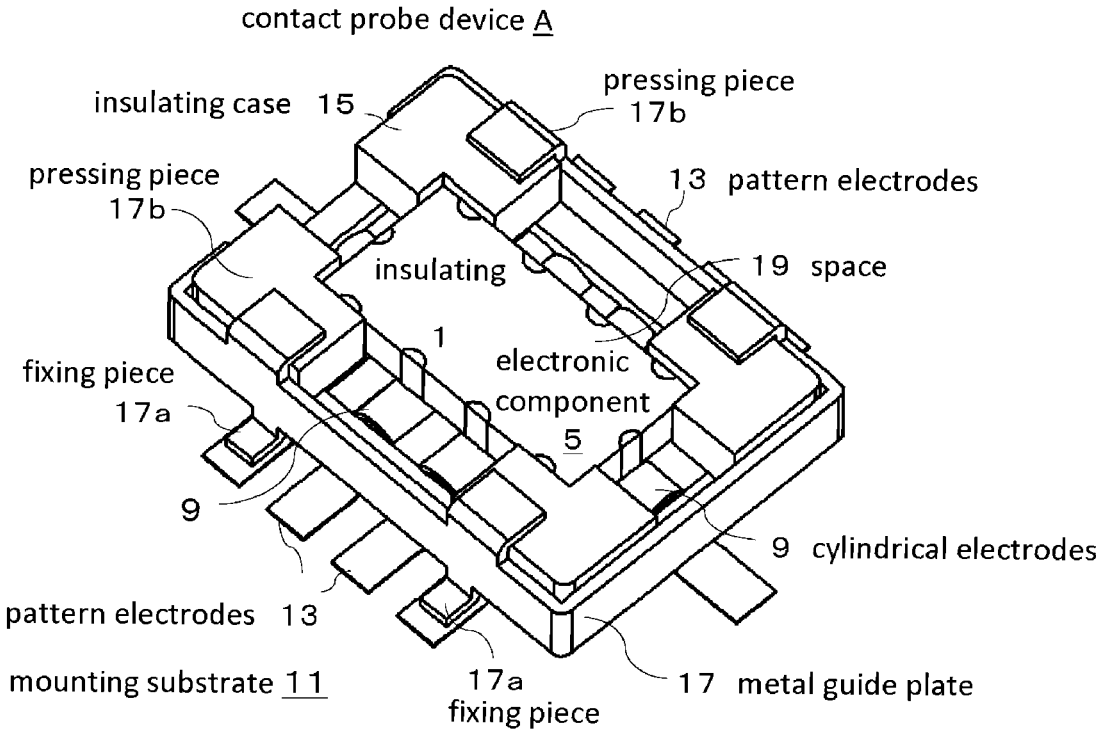
FIG. 6 is a perspective view explaining a first application example of the contact probe device according to the present invention.
Figure 7:
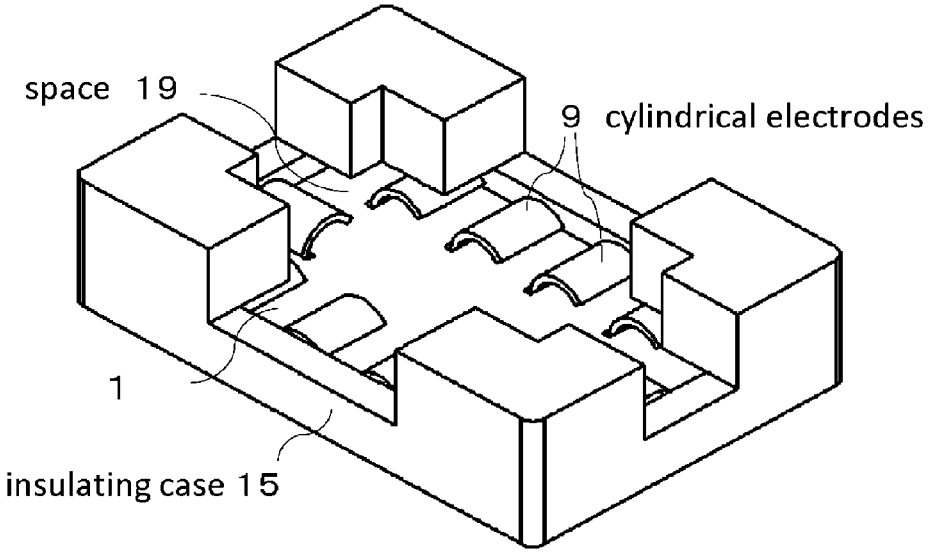
FIG. 7 is an exploded perspective view explaining the first application example.
Figure 7:
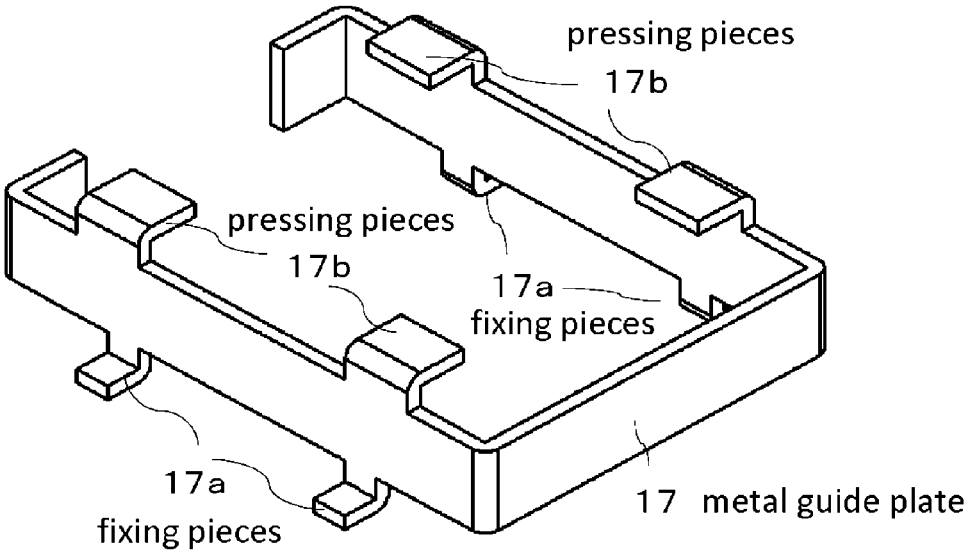
Figure 8:
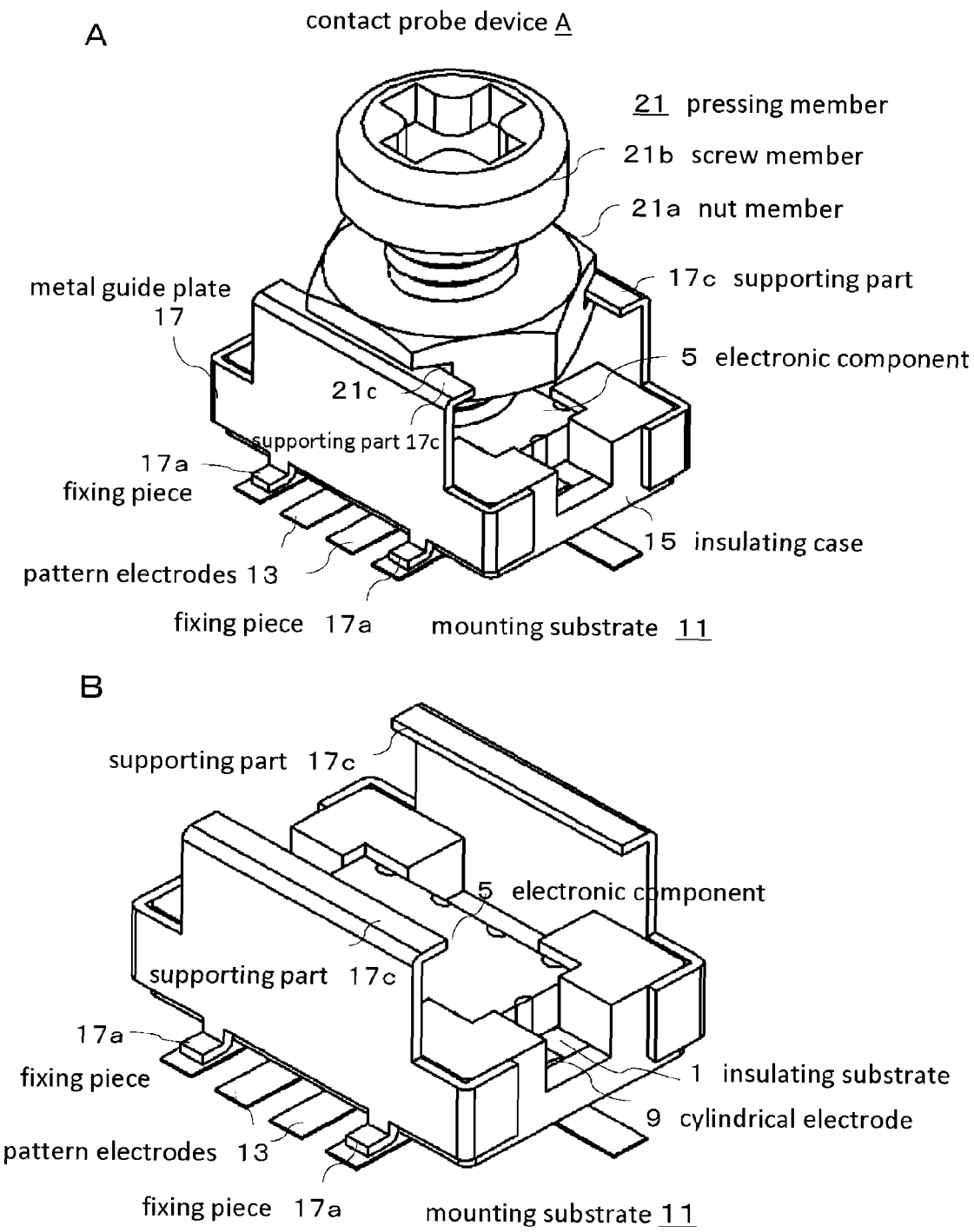
FIG. 8 is a perspective view and an exploded perspective view of a second application example of the contact probe device according to the present invention.
Figure 9:
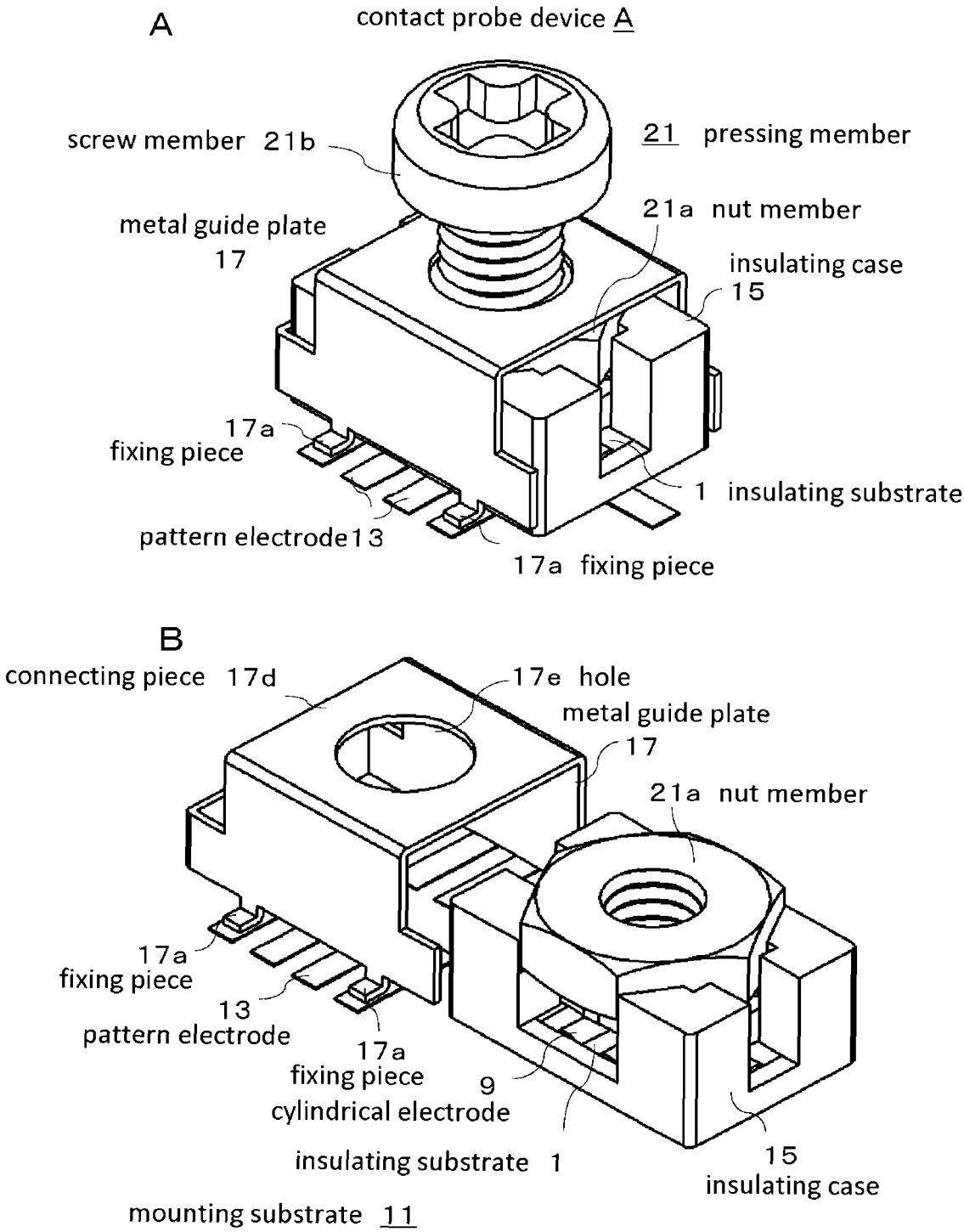
FIG. 9 is a perspective view and an exploded perspective view explaining a third application example of the contact probe device according to the present invention.

1 Insulating substrate
1*a* Short side
1*b* Long side
3 Cuts
5 Electronic component
7 Electrode
7*a*, 7*b* Input/output electrodes
7*c*, 7*d*, 7*e*, 7*f* Ground electrodes
9 Cylindrical electrodes
9*a* Slits
11 mounting substrate
13 Pattern electrodes
15 Insulating case
17 Metal guide plate
17*a* Fixing piece
17*b* Pressing piece
17*c* Supporting part
17*d* Connecting piece
17*e* Hole
19 Space
21 Pressing member
21*a* Nut member (suppressing member)
21*b* Screw member (pressing member)
21*c* Supporting slot
A Contact probe device

The invention claimed is:

1. A contact probe device, comprising:

an insulating substrate having a plurality of cuts with narrow widths formed from an outer peripheral end; and a plurality of cylindrical electrodes made of a conductive plate material, formed in an appearance of cylindrical shapes, and having slits extending in the axial direction, in such a manner as being supported by the insulating substrate by being inserted into the cuts of the insulating substrate so that the insulating substrate is fitted into the slits.

2. The contact probe device according to claim 1, wherein the insulating substrate has flexibility.

3. The contact probe device according to claim 1 or 2, comprising a frame-type insulating case into which the insulating substrate, with the cylindrical electrodes supported thereon, is fitted from one of the main surface sides, and in which a space is formed where the cylindrical electrodes and a main essential area of the insulating substrate are exposed on the opposed main surface side.

4. The contact probe device according to claim 3, comprising a metal guide plate that covers at least a lateral outer periphery of the insulating case, with a fixing piece protruded therefrom so as to be fixed to the mounting substrate of the electronic device.

5. The contact probe device according to claim 4, wherein a pressing member for pressing the electronic component stored in the space, is supported by the metal guide plate.

6. The contact probe device according to claim 5, wherein the pressing member has a nut member supported by the metal guide plate, and a screw member screwed into the nut member.

* * * * *